US005287835A

United States Patent [19]

Fiorenza, II et al.

[11] Patent Number: 5,287,835

[45] Date of Patent: Feb. 22, 1994

[54] ELECTRONIC GOVERNOR WITH FAST RESPONSE TIME

[75] Inventors: John A. Fiorenza, II, Slinger; John B. Gonnering, West Bend, both of Wis.

[73] Assignee: Briggs & Stratton Corporation, Wauwatosa, Wis.

[21] Appl. No.: 911,949

[22] Filed: Jul. 10, 1992

[51] Int. Cl.[5] ..... F02D 41/14

[52] U.S. Cl. ..... 123/352; 123/361

[58] Field of Search ..... 123/339, 352, 353, 354, 123/355, 361, 399

[56] References Cited

U.S. PATENT DOCUMENTS

| | | | |
|---|---|---|---|
| 3,001,115 | 9/1961 | Gendreu et al. | 318/137 |
| 3,034,028 | 5/1962 | Jamieson | 318/607 |
| 3,207,255 | 9/1965 | Hahlganss et al. | 123/353 X |
| 3,214,662 | 10/1965 | de Wolf | 318/129 |
| 3,278,875 | 10/1966 | McDonough | 335/272 |
| 3,344,880 | 10/1967 | Iwashita et al. | 123/352 X |
| 3,435,395 | 3/1969 | Rosenberg et al. | 335/276 |
| 3,563,331 | 2/1971 | Kato et al. | 123/361 X |
| 3,597,712 | 8/1971 | Nakagome | 335/71 |
| 3,644,763 | 2/1972 | Skrobisch | 310/36 |
| 3,694,782 | 9/1972 | Ray | 335/230 |
| 3,800,755 | 4/1974 | Klaiber et al. | 123/361 |
| 3,870,931 | 3/1975 | Myers | 361/194 |
| 3,949,250 | 4/1976 | Walker et al. | 310/36 |
| 3,970,979 | 7/1976 | Montagu | 335/229 |
| 4,227,164 | 10/1980 | Kitahara | 335/230 |
| 4,246,504 | 1/1981 | Clifford et al. | 310/181 |
| 4,275,371 | 6/1981 | Vogel | 335/272 |
| 4,409,940 | 10/1983 | Gaus | 123/361 |
| 4,432,033 | 2/1984 | Brundage | 361/152 |
| 4,447,793 | 5/1984 | Gray | 333/106 |
| 4,453,517 | 6/1984 | Kasiewicz | 123/352 |
| 4,491,815 | 1/1985 | Idogaki et al. | 335/229 |
| 4,508,078 | 4/1985 | Takeuchi et al. | 123/399 |
| 4,510,403 | 4/1985 | Vanderlaan et al. | 310/36 |
| 4,600,864 | 7/1986 | Sato | 318/254 |
| 4,603,675 | 8/1986 | Junginger et al. | 123/478 |
| 4,612,526 | 9/1986 | Vanderlaan et al. | 335/229 |
| 4,660,520 | 4/1987 | Inoue et al. | 123/399 |
| 4,724,811 | 2/1988 | Maisch | 123/361 |
| 4,735,183 | 4/1988 | Inoue et al. | 123/399 |
| 4,768,483 | 9/1988 | Asayama | 123/399 |
| 4,779,069 | 10/1988 | Brown | 335/284 |
| 4,804,934 | 2/1989 | Finke et al. | 335/229 |
| 4,816,707 | 3/1989 | Vanderlaan | 310/36 |
| 4,823,749 | 4/1989 | Eisenmann et al. | 123/339 |
| 4,831,985 | 5/1989 | Mabee et al. | 123/399 |
| 4,850,322 | 7/1989 | Uthoff et al. | 123/399 |
| 4,868,434 | 9/1989 | Hayashi | 310/42 |
| 4,899,073 | 2/1990 | Takeuchi et al. | 310/116 |
| 4,938,190 | 7/1990 | McCabe | 123/399 |
| 5,003,948 | 4/1991 | Churchill et al. | 123/352 |
| 5,016,588 | 5/1991 | Pagdin et al. | 123/399 |
| 5,036,817 | 8/1991 | Tomikawa et al. | 123/399 |
| 5,072,328 | 12/1991 | Dvorak et al. | 361/210 |
| 5,113,824 | 5/1992 | Haubner | 123/399 |

FOREIGN PATENT DOCUMENTS

| | | | |
|---|---|---|---|
| 1236085 | 6/1960 | France | 335/272 |

OTHER PUBLICATIONS

William A. Fleisher, "Brushless Motors for Limited Rotation", Machine Design, Dec. 7, 1989.

William David Cooper, "Electronic Instrumentation and Measurement Techniques", Second Edition, Chapter 4, 1978.

*Primary Examiner*—Tony M. Argenbright

*Attorney, Agent, or Firm*—Andrus, Sceales, Starke & Sawall

[57] ABSTRACT

The electronic governor has a fast response time by eliminating the return spring of prior art governors. Instead, a magnetic field generated either by permanent magnets or by a second actuator coil is used to oppose the force created by a first actuator coil. The current to the first actuator coil is pulse width modulated. If a second coil is used instead of permanent magnets, the current to the second coil may be either pulse width modulated or may be a constant DC signal. An actuator having a low inertia rotor and a stationary core is preferred to further reduce the response time.

8 Claims, 6 Drawing Sheets

ELECTRONIC GOVERNOR WITH FAST RESPONSE TIME

BACKGROUND OF THE INVENTION

This invention relates to electronic speed governors used in internal combustion engines. More particularly, this invention relates to governors for small engines used in lawnmowers, snowblowers, generators, and the like.

Typical prior art electronic governors use an actuator and a return spring to maintain throttle plate position. The actuator has a coil that is responsive to a control signal from the electronic circuit or microprocessor. In response to the control signal, the actuator drives the throttle in a first direction. The return spring is connected to oppose the actuator force and tends to pull the throttle in the opposite direction.

A major disadvantage of these prior art electronic governors is that they have a very slow response time. The slow response time is due to several factors, including the spring force of the return spring. The spring force varies with throttle position. Near the wide open throttle position, the spring force is about 6 ounces of force, corresponding to 50 to 70 percent of the actuator force. Near the closed throttle position, the spring force is less, about 2 ounces of force.

The effect of the return spring force is apparent from the basic force equation of the system:

$$F=M\times A, \tag{1}$$

Where

F = the total force of the actuator, spring, linkage, and throttle plate system;

M = the total mass of the moving components in the system; and

A = the acceleration of the system.

It is also clear that $$A=F/M. \tag{2}$$

It is apparent from equation (2) that either increasing the system force F and/or decreasing its mass M will increase the acceleration A of the system. Since the acceleration A of the system is inversely proportional to the system response time, an increase in acceleration A will decrease the response time.

The total system force F is given by the following equation:

$$F=F_A-F_T-F_F-F_S, \tag{3}$$

Where $F_A$ = the actuator force;

$F_T$ = the force on the throttle plate caused by moving air;

$F_F$ = the friction force of the system components; and $F_S$ = the spring force of the return spring.

The total force of the system may be increased by simply increasing the actuator force $F_A$, which generally means that a larger actuator must be used. However, the use of large actuators is very expensive and increases the weight of the governor.

The throttle plate force $F_T$ can theoretically be decreased to increase the total system force F. However, decreasing the throttle plate force may result in an unsafe, overspeed condition since the throttle plate force is typically necessary to close the throttle if there is a break in the linkage between the actuator and the throttle plate.

Since the friction force $F_F$ is always minimized but never totally eliminated, it is difficult to reduce this negative force.

Since prior art systems typically require a return spring to oppose the actuator force, prior art systems cannot eliminate the spring force $F_S$.

Therefore, the only way prior art systems could increase the total force F and thus increase the acceleration A and decrease the response time was to increase the actuator force $F_A$. As stated above, this solution required a heavier and more expensive actuator.

SUMMARY OF THE INVENTION

An electronic governor with a fast response time is disclosed that uses a unique actuator and that eliminates the return spring of prior art devices.

In its broadest concept, the electronic governor includes a means for generating and storing an engine set speed, a means for determining the engine speed, means for comparing the engine speed to the set speed, and an actuator having a coil that creates a first magnetic field in the actuator stator in a first flux direction in response to a control signal if the engine speed is not substantially equal to the set speed. The governor also includes a means for creating a second magnetic flux field to bias the rotor in the opposite direction.

In a preferred embodiment, the actuator includes two coils which create respective sets of magnetic flux lines in opposite directions. The current through the first coil is pulse width modulated and tends to rotate the actuator rotor or to move an actuator bar magnet in a first direction to move the throttle plate in a first direction. The current in the second coil may either be constant, or may be pulse width modulated as well.

In an alternate embodiment, the second coil may be replaced by permanent magnets to bias the rotor at a constant force in the second direction.

In another alternate embodiment, the means for creating the second flux field includes a second actuator having a second coil interconnected therewith. The second control signal operates the second coil, thereby causing the second actuator to rotate the engine throttle in the second direction.

Also in a preferred embodiment, the electronic governor includes a microprocessor which generates the set speed, calculates the actual engine speed, and generates control signals to control the actuator coils.

The actuator rotor, or both actuator rotors if two actuators are used, are preferably of a low inertia design having a stationary core of a highly permeable magnetic material and two rotating arc magnets which are spaced from the stationary core.

It is a feature and advantage of the present invention to provide an electronic governor having a very fast response time which is still inexpensive.

It is another feature of the present invention to provide an electronic governor in which the return spring is eliminated to improve response time.

It is yet another feature and advantage of the present invention to provide an electronic governor having a unique actuator with two means for generating opposed magnetic fields to determine the throttle position.

It is yet another feature and advantage of the present invention to provide a microprocessor-based electronic governor that is simple, inexpensive and accurate, yet which still has a very fast response time.

These and other features of the present invention will be apparent to those skilled in the art from the following detailed description of the preferred embodiments and the attached drawings, in which:

BRIEF DESCRIPTION OF THE DRAWINGS

FIG. 4*a* depicts the turn-on signal for coil 1. FIG. 4*b* depicts the turn-on signal for coil 2.

FIG. 10(*a*) is a plan view of the actuator. FIG. 10(*b*) is a side view of the actuator, shown in partial section.

DETAILED DESCRIPTION OF THE PREFERRED EMBODIMENTS

The electronic governor according to the present invention has a decreased response time due to the elimination of the relatively slow-acting return spring.

In the prior art, the return spring was used to oppose the actuator force $F_A$. In the present invention, the actuator force in a first direction is opposed by an actuator force in the opposite direction so that the resulting combined actuator force determines the throttle position.

The actuator force in the first direction is created by controlling the current to a first coil, thereby creating a first magnetic field having first lines of magnetic flux in a first direction which tends to rotate an actuator rotor or move an actuator bar magnet in a first direction.

A second coil or a pair of permanent magnets is used to create a second magnetic field having second lines of magnetic flux in a second direction that opposes the first lines of magnetic flux. If a second coil is used instead of permanent magnets, the current to the coil may be either a constant DC current or may be a pulse width modulated (PWM) signal for an even quicker response time. The second coil may be on the same actuator as the first coil or on a different actuator.

Figure 1:
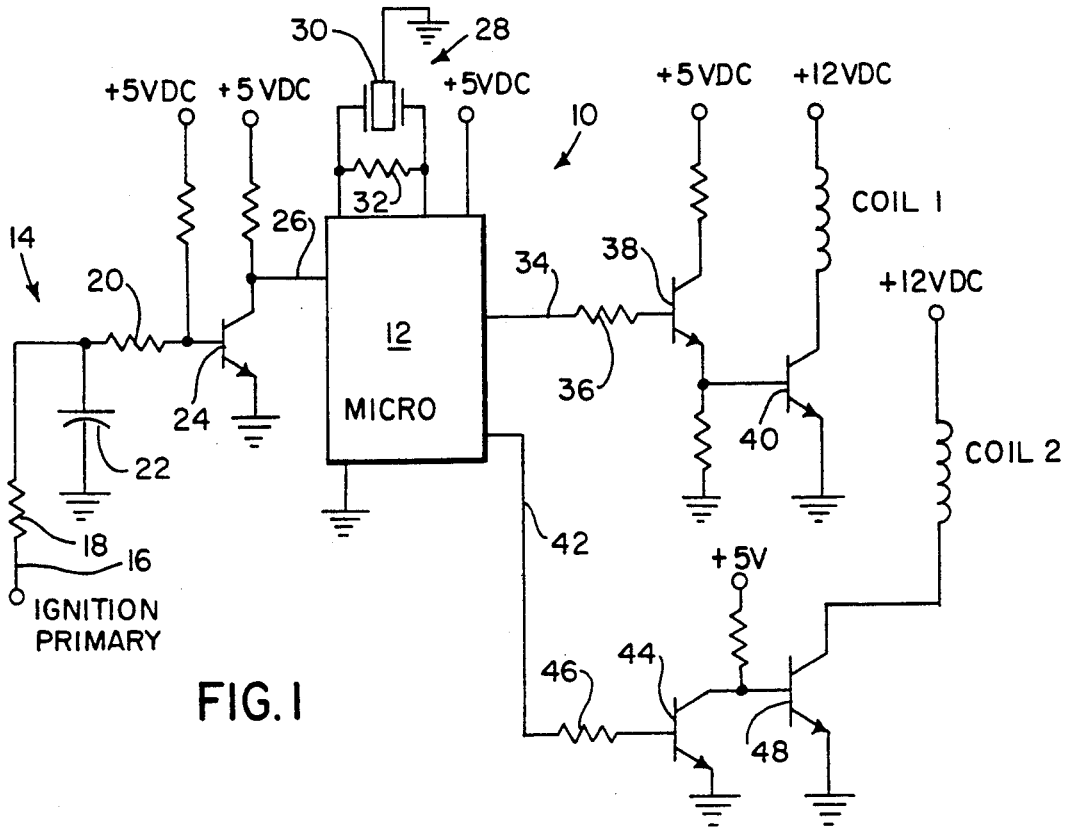
FIG. 1 is a schematic diagram of the preferred embodiment of the present invention.

FIG. 1 is a schematic diagram of the preferred embodiment of the present invention.

Governor 10 in FIG. 1 includes a microprocessor 12 which generates and stores a set speed, a means 14 for sensing the highly negative ignition firing voltage, and a means for inputting that information to microprocessor 12. Microprocessor 12 compares the set speed with the actual engine speed and outputs control signals to control the current through coils 1 and 2.

More specifically, the ignition primary winding signal is input on line 16 and is filtered by resistors 18 and 20 and capacitor 22. Transistor 24 is turned on between the ignition firings, thereby keeping input 26 to microprocessor 12 in the low state. When the ignition primary fires, transistor 24 is turned off, thereby causing +5 volts to be applied to pin 26 of the microprocessor. An oscillator 28, including a crystal 30 and a resistor 32, provides the clock signal for microprocessor 12. In a preferred embodiment, the frequency of oscillator 28 is 4 Mhz, which is divided down to a clock signal of 2 Mhz for microprocessor 12. Microprocessor 12 is preferably an 8-bit controller such as a part number MC68HC05B4 controller available from Motorola. The software for driving microprocessor 12 is discussed below in connection with FIGS. 5 and 6.

In the preferred embodiment depicted in FIG. 1, microprocessor 12 outputs first and second pulse width modulated DC control signals to first and second coil means respectively. Each of the coil means includes its respective coil and circuitry to control the coil. Coils 1 and 2 are identical, each having 500 turns of 27 gauge copper wire. The first control signal output on line 34 is filtered by resistor 36 and becomes the base current for transistor 38. The emitter of transistor 38 is connected to the base of transistor 40, and the collector of transistor 40 is connected to coil 1. Whenever the first control signal on line 34 goes high, transistor 38 is turned on which then turns on transistor 40, allowing one amp or more of current to pass through coil 1 from a battery or other 12 VDC power supply. Whenever the first control signal goes low, transistor 38 is turned off, which then turns off transistor 40. No current then passes through coil 1.

In FIG. 1, coil 2 is operated by a second control signal, which is preferably identical to the first control signal. The second control signal output by microprocessor 12 on line 42 controls the base of transistor 44 through resistor 46. The base of transistor 48 is connected to transistor 44. Transistor 48 is turned on whenever transistor 44 is off. Transistor 48 is off whenever transistor 44 is on. Transistor 44 is off whenever the control signal goes low. When the control signal goes high, transistor 44 is turned on. When transistor 48 is gated on, current passes through coil 2 from a 12 VDC power supply.

Although microprocessor 12 outputs the same first and second control signals to transistors 38 and 44, coils 1 and 2 are controlled by different transistor-transistor logic (TTL) circuits. Due to the different TTL circuits, coil 2 is turned off whenever coil 1 is turned on, and coil 2 is turned on whenever coil 1 is turned off.

Figure 2:
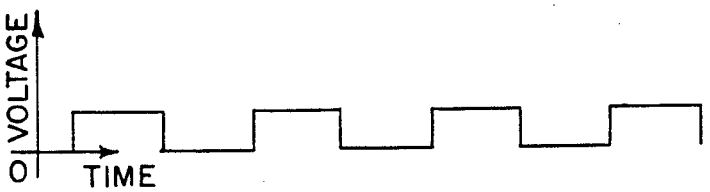
FIG. 2 is a timing diagram of the turn-on signals for coils 1 and 2 in FIG. 1.

FIG. 2 is a timing diagram depicting the preferred profile of the pulse width modulated control signals to coil 1 and coil 2. In a preferred embodiment, the second control signal for coil 2 is the same as the control signal for coil 1, so that the second control signal is high whenever the first control signal is high, and the second control signal is low whenever the first control signal is low. This arrangement yields the fastest response time in positioning the throttle to the desired position since only a single actuator force is acting at any given instant. Whenever the first control signal is high, the throttle plate will tend to move in a first direction. When the first control signal goes low, the throttle plate tends to move in the opposite direction since the second control signal is also low. The balance between the two coils achieves the desired throttle plate position with minimal response time.

Instead of using pulse width modulated signals to control coil 1 and coil 2, the signals to the coils could be rapidly turned on and off in an alternating manner. This approach is only feasible if engine speed is sensed on a frequent basis, e.g. 3600 times per second using a 60-tooth gear. If the speed is too high, coil 1 is turned on. If the speed is too low, then coil 2 is turned on.

Another approach would be to convert the microprocessor's digital output control signals to analog signals, and use the analog signals to control the coils. Such an approach is disclosed in U.S. Pat. No. 4,875,448 issued Oct. 24, 1989 to Dykstra, and incorporated by reference herein.

Figure 3:
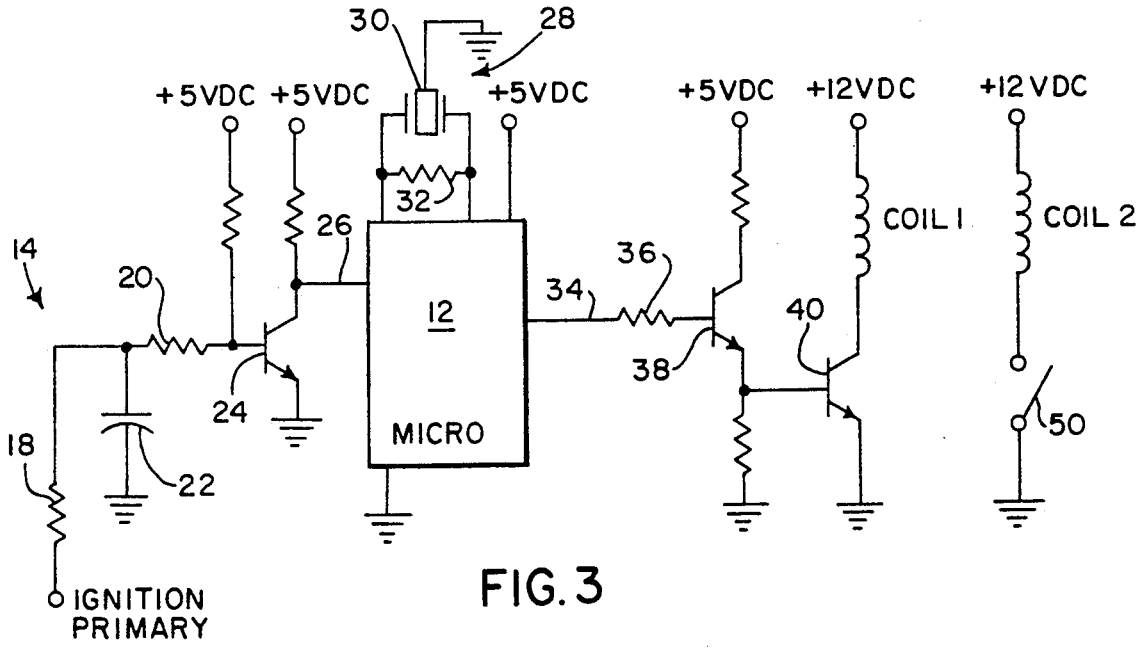
FIG. 3 is a schematic diagram of an alternate embodiment of the present invention in which coil 2 is held at a constant twelve volts.

FIG. 3 is a schematic diagram of an alternate embodiment of the present invention. The primary difference between the embodiment of FIG. 3 and the embodiment of FIG. 1 is that the microprocessor in FIG. 3 only outputs a single control signal, which controls coil 1. In FIG. 3, current is always flowing through coil 2 from a 12 VDC battery or other power supply as long as switch 50 is closed. Thus, coil 2 generates a constant magnetic field having flux lines in a second direction opposite to the flux lines generated by coil 1 when coil 1 is turned on. The force resulting from coil 2 will tend to move the throttle in the second direction whenever the pulse width modulated turn on signal for coil 1 goes to a low state, or whenever coil 1 has an average on time small enough to create an average flux that is less than the flux from coil 2.

Figure 4A:
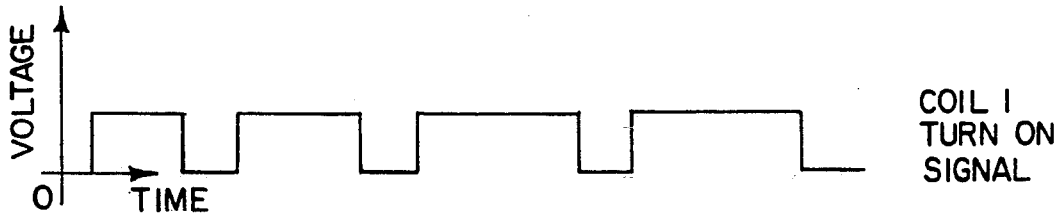
FIGS. 4*a* and 4*b* are timing diagrams corresponding to the schematic of FIG. 3.
Figure 4B:
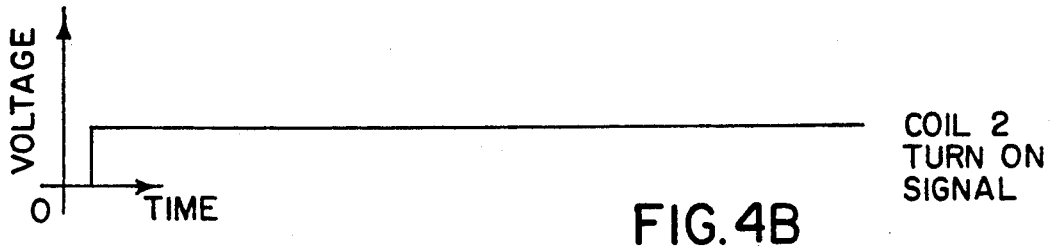

FIGS. 4*a* and 4*b* depict typical turn on signals for coil 1 and coil 2 respectively. As shown in FIG. 4*a*, the coil 1 turn on signal is a pulse width modulated DC signal. On the other hand, the turn on signal for coil 2 depicted in FIG. 4*b* is a constant high state DC signal.

Figure 5:
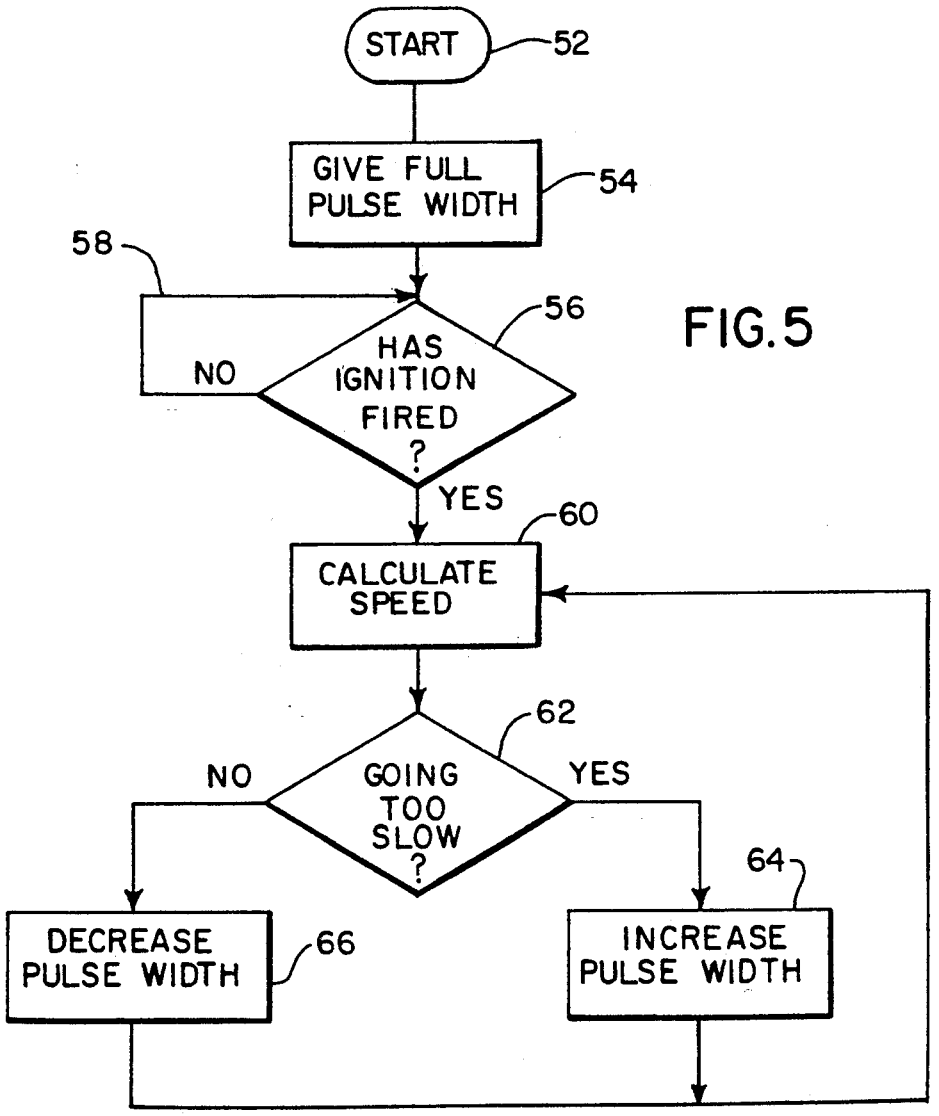
FIG. 5 is a summary flowchart of the software used to run the microprocessors in FIGS. 1 and 3.
Figure 6:
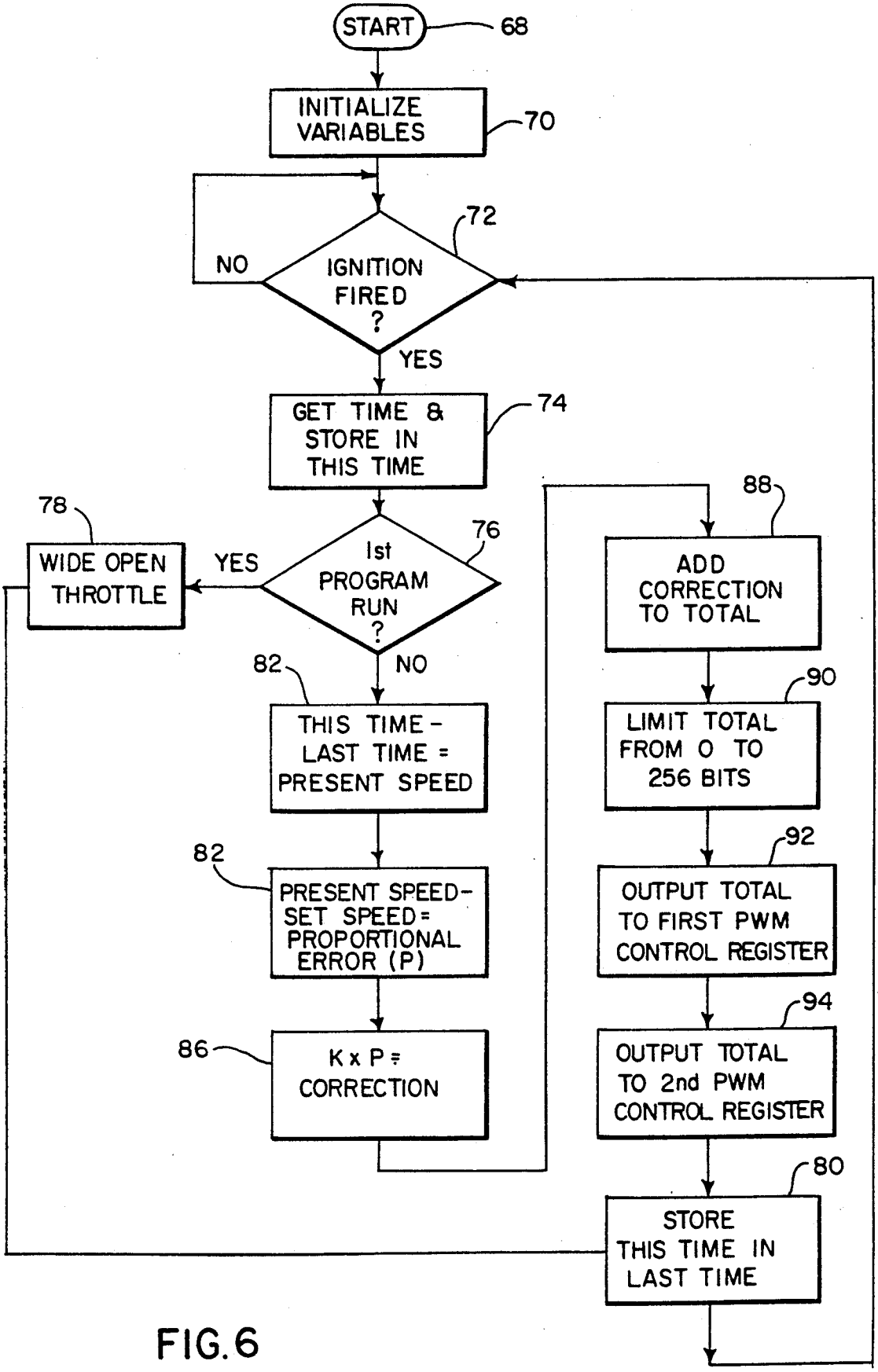
FIG. 6 is a more detailed flowchart of the software used to run the microprocessors in FIGS. 1 and 3.

FIGS. 5 and 6 are flow charts of the software used to operate the microprocessor in FIGS. 1 and 3. FIG. 5 is a summary flow chart for the first control signal that turns on coil 1. FIG. 6 is a more detailed flow chart which may be used with the embodiments of either FIGS. 1, 3 or 12.

In FIG. 5, after the program starts at step 52, a full pulse width is provided to coil 1 at step 54. The full pulse width is provided since it is desirable to have the throttle at the wide open throttle position upon engine starting. A determination is then made at step 56 whether ignition firing has occurred. If not, the program gram loops back via line 58. If an ignition firing is detected, the speed is calculated at step 60 by determining the time between successive ignition pulses. A determination is also made at step 60 whether the actual engine speed differs from the stored engine set speed. If there is a difference between the actual engine speed and the set speed, a determination is made at step 62 whether the actual speed is below the set speed. If the answer is Yes at step 62, the pulse width of the coil 1 control signal is increased at step 64, thereby further opening the throttle. If the answer is No at step 62, the pulse width is decreased at step 66 to move the throttle toward the closed position. The program then loops back to step 60 where the engine speed is again calculated.

FIG. 6 is a more detailed flow chart of the software used to drive the microprocessor of FIGS. 1 and 3. In FIG. 6, the program starts to run at step 68 when the engine is started. The variables are initialized at step 70 and then a determination is made at step 72 whether the ignition has fired. If the answer at step 72 is No, the program loops back to step 72 until an ignition firing has been detected. When the answer to 15 step 72 is Yes, the clock time at which the ignition firing is detected is obtained and is stored in a memory location called THIS TIME at step 74. A determination is then made at step 76 whether this is the first run of the program. If the answer of step 76 is Yes, a full pulse width signal is provided to coil 1 at step 78 to achieve the wide open throttle position. The program then branches to step 80 whereupon the value in the THIS TIME register is moved to a register called LAST TIME.

If the answer at step 76 is No, a value must already be stored in the LAST TIME register. The value in the LAST TIME register is then subtracted from the value in the THIS TIME register at step 82 to determine the period of the current engine speed. This difference is stored in a memory location called PRESENT SPEED. At step 84, a value stored in a memory location called SET SPEED—which corresponds to the engine set or governed speed—is subtracted from the PRESENT SPEED value. The difference is stored in a register called PROPORTIONAL ERROR or P.

Since the control system described herein uses Proportional control, the PROPORTIONAL ERROR or P value is multiplied by a constant K to yield a correction factor. This calculation is made at step 86, with the result being stored in a register called CORRECTION. The value of the CORRECTION register is then added at step 88 to a running total of the correction values called TOTAL. The value stored in TOTAL represents the pulse width of the first control signal for coil 1. This running total is between 0 to 256 bits, equalling zero pulse width to a full pulse width.

The value of TOTAL is limited to a number between 0 to 256 bits at step 90 to prevent the TOTAL value from rolling over once the maximum or minimum value in the range has been reached. The value in the TOTAL register is then output to a first pulse width modulation control register at step 92. The first PWM control register is used to output the control signal for coil 1.

If a constant DC control signal is being used to control coil 2 as in the FIG. 3 embodiment, the program proceeds from step 92 directly to step 80. If the second coil is being turned on in response to a pulse width modulated signal that is identical to the coil 1 control signal as in the FIG. 1 embodiment, the software proceeds from step 92 to step 94. At step 94, the value in the TOTAL register is output to a second PWM control register. The second PWM control register outputs the signal used to turn on or off transistor 44, which in turn causes coil 2 to be turned off or on.

The program then proceeds to step 80, where the value in the THIS TIME register is stored in the LAST TIME register. The program returns to step 72 and waits until another ignition firing is detected.

Figure 7:
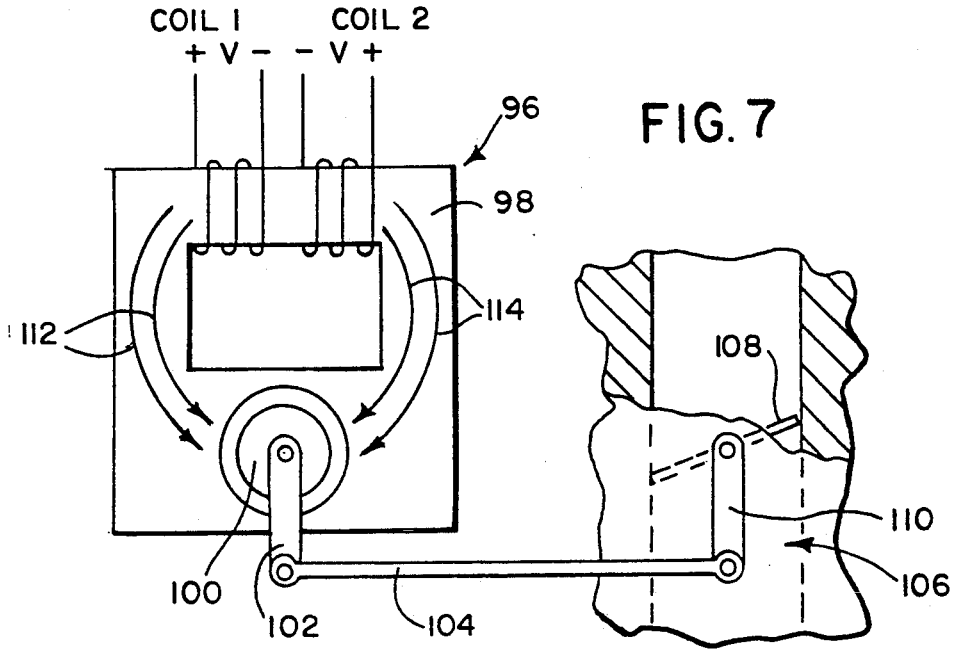
FIG. 7 is a diagrammatical view of the preferred actuator-throttle assembly according to the present invention.
Figure 8:
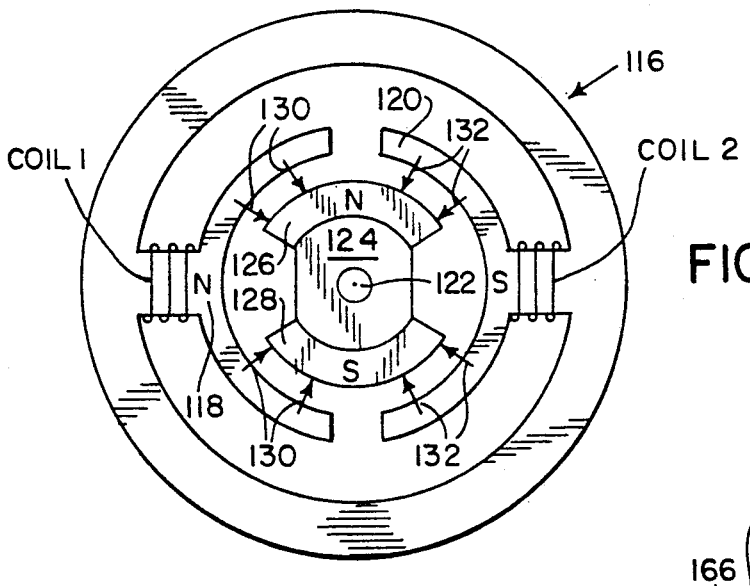
FIG. 8 is a plan view of an alternate actuator that may be used in the present invention.
Figure 9:
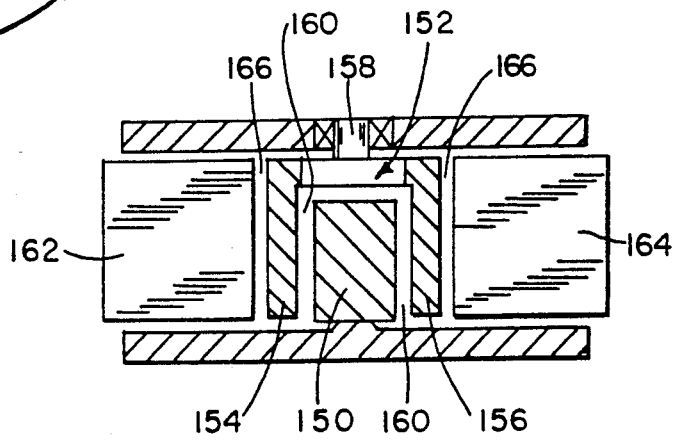
FIG. 9 is a side cross-sectional view of a low inertia actuator rotor which may be used in the present invention.
Figure 10A:
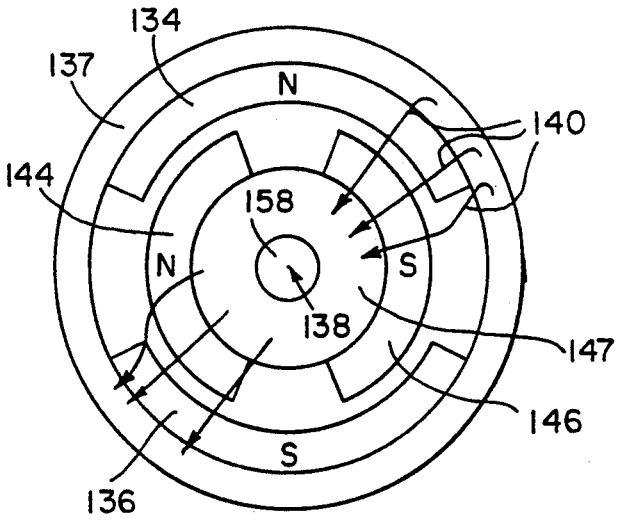
FIGS. 10(*a*) and 10(*b*) depict a third embodiment of an actuator that may be used in the present invention.
Figure 10B:
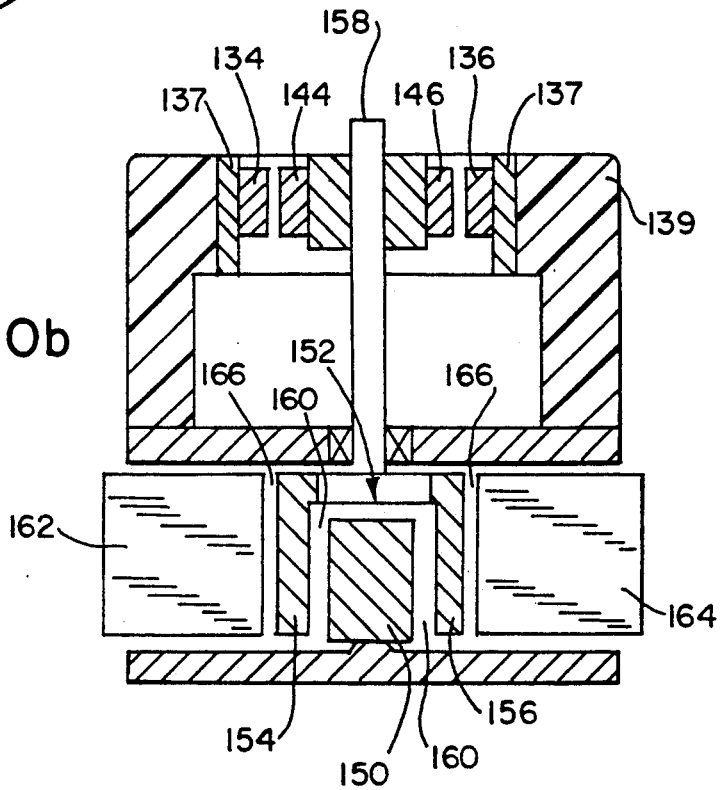

FIGS. 7, 8, 10(*a*)–10(*b*) and 11 depict different actuators which may be used with the present invention. FIG. 9 is a cross-sectional side view of a low inertia actuator rotor which may be used with one of the actuators in FIGS. 7, 8, or 10(*a*)–10(*b*).

In FIG. 7, actuator 96 includes a stator 98 made from a magnetically permeable material, a rotor 100, coil 1, coil 2, and an arm 102 connected to rotor 100. The assembly in FIG. 7 also includes a link arm 104 that is connected to a throttle 106. The throttle includes a movable throttle plate 108 and arm 110.

As depicted in FIG. 7, coil 1 and coil 2 are connected so that current flows in opposite directions through the coils. The current flow in coil 1 creates magnetic flux lines 112 which travel in a first direction through rotor 100. The current flow in coil 2 creates magnetic flux lines 114 which travel in a second direction through rotor 100. Coil 1 is preferably a coil having 500 turns of 27 gauge copper wire, yielding 8 ounces of force. Coil 2 preferably has 250 turns of 27 gauge copper wire, yielding 4 ounces of force. The interplay of the magnetic forces resulting from coil 1 and coil 2 determines the position of rotor 100, and hence the position of throttle plate 108 interconnected therewith.

FIG. 8 is a plan view of another two-coil actuator which may be used in place of the actuator of FIG. 7. In FIG. 8, actuator 116 includes coil 1 wrapped on a first stator section 118, and coil 2 wrapped on a second stator section 120. Rotor 122, like rotor 100 of FIG. 7, includes a magnetically permeable core 124 and two arc magnets 126 and 128 having opposite polarities. The arc magnets are disposed on a portion of the perimeter of core 124.

When coil 1 is turned on, stator section 118 becomes a North pole and magnetic flux lines 130 travel in a first direction through rotor 122. When coil 2 is turned on, stator section 120 also becomes a North pole and magnetic flux lines 132 travel in an opposite, second direction through rotor 122. The interplay between flux lines 130 and 132 determines the position of rotor 122, and thus the position of the throttle plate.

Figure 12:
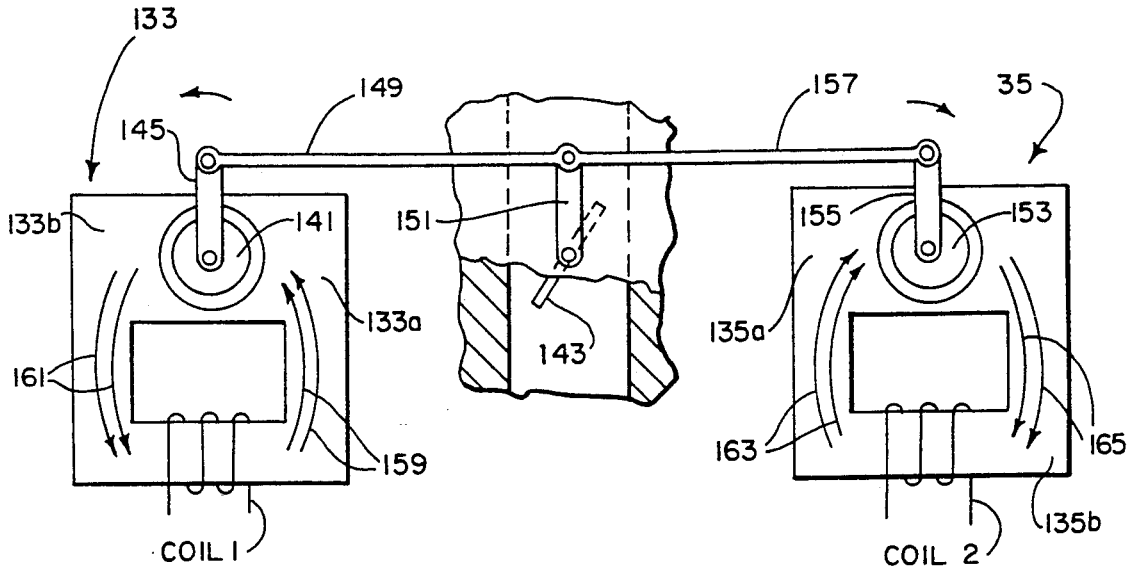
FIG. 12 is a diagrammatical view of an alternate embodiment using two opposed actuators interconnected with the engine throttle.

FIG. 12 is an alternate embodiment of the present invention which uses two actuators to control the throttle position in place of the single actuator in the embodiments discussed above. In FIG. 12, coil 1 is interconnected with a first actuator 133, and coil 2 is interconnected with a second actuator 135. Rotor 141 of first actuator 133 is interconnected with throttle plate 143 via link arms 145, 149 and 151. Similarly, rotor 153 of second actuator 135 is interconnected with throttle plate 143 via link arms 155, 157 and 151.

The circuit used to operate coil 1 and coil 2 is similar to that depicted in FIG. 1. Coil 1 is responsive to the first control signal, and coil 2 is responsive to the second control signal as discussed above in connection with FIG. 1.

When the first control signal allows current to pass through coil 1, the coil current creates magnetic flux lines 159 in stator section **133*a* which pass through rotor 141 in a first direction. Magnetic flux lines 161 in stator section 133*b* comprise the return path for the magnetic flux. The magnetic field created when coil 1 is energized rotates rotor 141 in the counterclockwise direction, thereby rotating throttle plate 143 in a first direction via link arms 145, 149 and 151**.

When coil 2 is energized in response to the second control signal, magnetic flux lines 163 are created in stator section **135*a* of second actuator 135. The flux field consisting of flux lines 163 rotates rotor 153 in the clockwise direction, thereby rotating throttle plate 143 in the opposite, second direction via link arms 155, 157 and 151. Flux lines 165 in stator section 135*b*** comprise the return path for the magnetic flux.

The design of actuators 133 and 135 may be similar to that of actuator 96 of FIG. 7 except that each of actuators 135 and 135 only uses a single coil. Likewise, actuators 133 and 135 may each have a similar design to actuator 116 of FIG. 8 as long as the coils in the embodiment of FIG. 8 are connected in series to effectively comprise a single coil.

Rotor 141 of first actuator 133 and rotor 153 of second actuator 135 are preferably of the low inertia design discussed herein in connection with FIG. 9. However, alternate rotor designs may be used, such as the rotor depicted and described in connection with FIG. 8, or the rotor depicted in FIG. 11 as long as the latter rotor is modified so that it effectively carries only a single coil.

FIG. 9 is a cross-sectional side view of an actuator core and rotor assembly that may be used with the present invention. The actuator of FIG. 9 is preferred because the rotor has a relatively low mass and thus a low inertia since the core is stationary. The low inertia rotor allows it to respond much quicker than typical rotors, further decreasing the response time of the electronic governor. The actuator assembly depicted in FIG. 9 is described in U.S. Pat. No. 5,038,064 issued Aug. 6, 1991 to the same inventor and assignee of the present invention. The specification of U.S. Pat. No. 5,038,064 is incorporated by reference herein.

The actuator of FIG. 9 has a stationary core 150 made from a highly permeable magnetic material such as soft iron. The actuator includes a rotor 152 having interconnected therewith two permanent magnets 154 and 156 of opposite polarities. Permanent magnets 154 and 156 are interconnected With a rotatable shaft 158 and thus rotate with the shaft. Magnets 154 and 156 are spaced from stationary core 150 to create an air gap 160 between the permanent magnets and the stationary core.

The actuator of FIG. 9 also includes opposed stator sections 162 and 164 which are made from a magnetically permeable material. Stator sections 162 and 164 are spaced from permanent magnets 154 and 156 respectively to create an air gap 166 therebetween.

Any of the actuators discussed above in connection with FIGS. 7 and 8 may be readily modified to receive the rotor-stationary core assembly depicted in FIG. 9. Such modifications are well within the skills of an ordinary person in the art.

FIGS. **10(*a*)–10(*b*) depict a third embodiment of an actuator, in which the low inertia actuator of FIG. 9 that is controlled by coil 1 has an additional permanent magnet assembly disposed on top of it as a replacement for coil 2** of FIGS. 7 and 8.

FIG. **10(*a*) is a plan view of the third embodiment; FIG. 10(*b*) is a side view, shown in partial section. In the embodiment of FIGS. 10(*a*) and 10(*b*), coil 2 of FIGS. 7 and 8 has been replaced by a permanent magnet assembly that includes a pair of permanent arc magnets 134 and 136 having opposite polarities. Arc magnets 134 and 136 apply a constant magnetic force to rotor 138 via flux lines 140. Arc magnets 134 and 136 are connected to a flux return ring 137, which is insulated by a plastic, non-permeable layer 139 (FIG. 10(*b*)). The magnetic field created by flux lines 140 causes rotor 138 to rotate in the counter-clockwise direction. Rotor 138 includes a pair of arc magnets 144 and 146 having opposite polarities, and a central core 147** of a magnetically permeable material.

Low inertia rotor 152 depicted in FIG. 10(*b*) operates in a similar manner to the low inertia rotor depicted in FIG. 9, except that the position of rotor 152 in FIG. 10(*b*) is determined by both the flux created by coil 1 and by the permanent magnet-rotor assembly discussed above which replaces coil 2.

Figure 11:
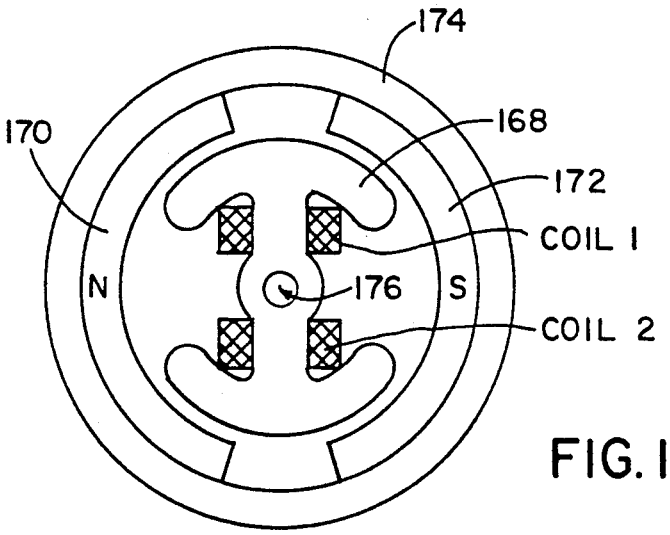
FIG. 11 is a plan view of an alternate actuator having the coils disposed on the rotor.

FIG. 11 depicts an alternate actuator rotor in which coils 1 and 2 are disposed on the rotatable rotor instead of the permanent magnets being disposed on the rotor.

In FIG. 11, an iron rotor 168 has both coil 1 and coil 2 disposed thereon. The actuator stator includes two permanent magnets 170 and 172 which comprise the North and South magnetic poles, respectively. Permanent magnets 170 and 172 are surrounded by a stationary flux return ring 174 which is preferably made of iron. Shaft 176 is interconnected with both rotor 168 and with the engine throttle.

In response to their respective control signals, coils 1 and 2 create flux fields which cause rotor 168 to rotate in either a clockwise or a counterclockwise direction.

Several embodiments of the present invention have been shown and described. However, other alternate embodiments will be apparent to those skilled in the art and are within the intended scope of the present invention. Therefore, the invention is to be limited only by the following claims.

We claim:

1. An electronic governor that controls the position of an engine throttle to set the engine speed near or at a set speed, comprising;

means for storing said set speed;

means for determining the engine speed;

means for generating a first control signal if said engine speed is not substantially equal to said set speed; and an actuator interconnected with said engine throttle, including:

a stator having magnetic material;

a magnet means having a first magnet pole of a first polarity and having a second magnet pole of an opposite second polarity, said magnet means for magnetically interacting with said stator;

a rotatable rotor, coil means, including a coil disposed on said rotor and being operated in response to said first control signal, for creating a first flux field in said stator, thereby changing the position of at least one of said magnet means and said coil in a first magnet direction to move said throttle in a first throttle direction; and means, interconnected with said engine throttle, for creating a second flux field to thereby move said throttle in a second throttle direction opposite to said first throttle direction.

2. The electronic governor of claim 1, wherein said means for crating a second flux field includes a second coil means having a second coil disposed on said rotor, and wherein said electronic governor further comprises:

means for generating a second control signal, said second coil means being operated in response to said second control signal.

3. An electronic governor that controls the position of an engine throttle to set the engine speed near or at a set speed, comprising:

means for storing said set speed;

means for determining the engine speed;

means for generating a first control signal if said engine speed is not substantially equal to said set speed;

an actuator interconnected with said engine throttle, including:

a stator having magnetic material;

a magnet means having a first magnet pole of a first polarity and having a second magnet pole of an opposite second polarity, said magnet means for magnetically interacting with said stator;

coil means, including a coil and being operated in response to said first control signal, for creating a first flux field in said stator, thereby changing the position of at least one of said magnet means and said coil in a first magnet direction to move said throttle in a first throttle direction;

second coil means including a second coil, interconnected with said engine throttle, for creating a second flux field to thereby move said throttle in a second throttle direction opposite to said first throttle direction;

means for generating a second control signal, said second coil means being operated in response to said second control signal; and a second actuator interconnected with said engine throttle, said second coil being in magnet flux communication with said second actuator.

4. An electronic governor that controls the position of an engine throttle to set the engine speed near or at a set speed, comprising:

means for storing said set speed;

means for determining the engine speed;

means for generating a first control signal if said engine speed is not substantially equal to said set speed; and an actuator interconnected with said engine throttle, including:

a stator having magnetic material;

a magnet means having a first magnet pole of a first polarity and having a second magnet pole of an opposite second polarity, said magnet means for magnetically interacting with said stator;

first coil means, including a first coil and being operated in resposne to said first control signal, for creating a first flux field in said stator, thereby changing the position of at least one of said magnet means and said first coil in a first magnet direction to move said throttle in a first throttle direction;

second coil means including a second coil, interconnected with said engine throttle, for creating a second flux field to thereby move said throttle in a second throttle direction opposite to said first throttle direction; and means for generating a constant DC second control signal, said second coil means being operated in response to said second control signal.

5. The electronic governor of claim 4, wherein said DC signal generating means includes a battery.

6. An electronic governor that controls the position of an engine throttle to set the engine speed near or at a set speed, comprising:

means for storing said set speed;

means for determining the engine speed;

means for generating a first control signal if said engine speed is not substantially equal to said set speed; and an actuator interconnected with said engine throttle, including:

a stator having magnetic material;

a magnet means having a first magnet pole of a first polarity and having a second magnet pole of an opposite second polarity, said magnet means for magnetically interacting with said stator;

coil means, including a coil and being operated in response to said first control signal, for creating a first flux field in said stator, thereby changing the position of at least one of said magnet means and said coil in a first magnet direction to move said throttle in a first throttle direction; and means, interconnected with said engine throttle, for creating a second flux field to thereby move said throttle in a second throttle direction opposite to said first throttle direction;

wherein said magnet means includes a rotor having a first pair of permanent magnets, and wherein said means for creating a second flux field includes a second pair of permanent magnets disposed on opposite sides of said rotor.

7. An electronic governor that controls the position of an engine throttle to set the engine speed near or at a set speed, comprising:

means for storing said set speed;

means for determining the engine speed;

means for generating a first control signal if said engine speed is not substantially equal to said set speed; and an actuator interconnected with said engine throttle, including:

a stator having magnetic material;

a magnet means having a first magnet pole of a first polarity and having a second magnet pole of an opposite second polarity, said magnet means for magnetically interacting with said stator;

coil means, including a coil and being operated in response to said first control signal, for creating a first flux field in said stator, thereby changing the position of at least one of said magnet means and said coil in a first magnet direction to move said throttle in a first throttle direction;

means including a second actuator having a second coil, interconnected with said engine throttle, for creating a second flux field to thereby move said throttle in a second throttle direction opposite to said first throttle direction; and means for generating a second control signal to operate said second coil, said second actuator being interconnected with said throttle such that said throttle moves in said second throttle direction in response to said second actuator.

8. An electronic governor that controls the position of an engine throttle to set the engine speed near or at a set speed, comprising:

means for storing said set speed;

a processor that computes the engine speed, and that generates a first control signal if said engine speed is not substantially equal to said set speed;

a power source;

a switch that is responsive to said first control signal;

an actuator interconnected with said engine throttle including a stator having magnetic material;

a magnet means, including a rotor, for magnetically interacting with said stator;

coil means, disposed on said rotor and including a coil that is interconnected with said power source and with said switch, for creating a first flux field when said switch switches power from said power source to said coil in response to said first control signal, whereby the position of at least one of said magnet means and said coil is changed to move said throttle in a first throttle direction; and means interconnected with said engine throttle, for creating a second flux field to thereby move said throttle in a second throttle direction opposite to said first throttle direction.

* * * * *

UNITED STATES PATENT AND TRADEMARK OFFICE

CERTIFICATE OF CORRECTION

PATENT NO. 5,287,835

DATED February 22, 1994

INVENTOR(S) Fiorenza, II et al

It is certified that error appears in the above-indentified patent and that said Letters Patent is hereby corrected as shown below:

CLAIM 2, Col. 9, Line 57, delete "crating" and substitute therefor ---creating---;

Signed and Sealed this

Ninth Day of August, 1994

*Attest:*

*Attesting Officer*

BRUCE LEHMAN

*Commissioner of Patents and Trademarks*